US011035387B2

(12) United States Patent
Arikawa

(10) Patent No.: US 11,035,387 B2
(45) Date of Patent: Jun. 15, 2021

(54) FLUID EQUIPMENT

(71) Applicant: EAGLE INDUSTRY CO., LTD., Tokyo (JP)

(72) Inventor: Tatsuhiro Arikawa, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 16/491,125

(22) PCT Filed: Mar. 13, 2018

(86) PCT No.: PCT/JP2018/009637
§ 371 (c)(1),
(2) Date: Sep. 4, 2019

(87) PCT Pub. No.: WO2018/173845
PCT Pub. Date: Sep. 27, 2018

(65) Prior Publication Data

US 2020/0011384 A1 Jan. 9, 2020

(30) Foreign Application Priority Data

Mar. 21, 2017 (JP) ..... JP2017-053965

(51) Int. Cl.
*F15B 3/00* (2006.01)

(52) U.S. Cl.
CPC ..... *F15B 3/00* (2013.01); *F15B 2201/205* (2013.01); *F15B 2201/3153* (2013.01); *F15B 2201/413* (2013.01)

(58) Field of Classification Search
CPC ..... F15B 3/00; F15B 2201/205; F15B 2201/3153; F15B 2201/413
See application file for complete search history.

(56) References Cited

U.S. PATENT DOCUMENTS 2,536,628 A 1/1951 Denisoff ..... 60/54.5
2,540,676 A * 2/1951 Wall ..... B60T 17/06 138/30

(Continued)

FOREIGN PATENT DOCUMENTS

CN 101821514 9/2010 ..... F15B 1/07
CN 104863908 8/2015 ..... F15B 1/08

(Continued)

OTHER PUBLICATIONS

International Preliminary Report on Patentability issued in application No. PCT/JP2018/009637, dated Sep. 24, 2019 (7).

(Continued)

*Primary Examiner* — F Daniel Lopez
*Assistant Examiner* — Matthew Wiblin
(74) *Attorney, Agent, or Firm* — Hayes Soloway P.C.

(57) ABSTRACT

Fluid equipment includes a container configured for having first and second fluids therein, a first fluid outlet/inlet path provided for outflow and inflow of the first fluid, a second fluid outlet/inlet path for outflow and inflow of the second fluid, and a member configured for moving in the container in response to pressure of the first fluid, the fluid equipment transmitting energy from the first to the second fluid. A first bellows is configured such that one end is closed in a sealed state by the moving member, the other end is fixed to an inner surface part of the container in a sealed state, and the inside of the first bellows communicates with the first fluid outlet/outlet path.

11 Claims, 7 Drawing Sheets

(56) References Cited

U.S. PATENT DOCUMENTS

| | | | | |
|---|---|---|---|---|
| 3,884,305 | A * | 5/1975 | Livingston | A62C 37/08 169/37 |
| 6,250,199 | B1 * | 6/2001 | Schulte | E21B 33/0355 60/398 |
| 8,096,324 | B2 | 1/2012 | Nakaoka et al. | 138/31 |
| 9,388,830 | B2 | 7/2016 | Mizukami | F15B 1/103 |
| 2010/0186843 | A1 | 7/2010 | Wellner et al. | 138/30 |
| 2013/0113165 | A1 | 5/2013 | Sueyoshi et al. | 277/449 |

FOREIGN PATENT DOCUMENTS

| | | | | |
|---|---|---|---|---|
| CN | 105041942 | | 11/2015 | F15F 15/023 |
| DE | 10 2005 056 846 | | 5/2007 | F15B 15/01 |
| DE | 102012006608 | | 10/2013 | F15B 15/10 |
| EP | 1 337 760 | | 6/2006 | F15B 15/10 |
| GB | 1007132 | | 8/1962 | E05B 51/02 |
| GB | 1047983 | A * | 11/1966 | F15B 1/103 |
| JP | S49387 | | 1/1974 | F15B 15/10 |
| JP | 57076301 | A * | 5/1982 | F15B 1/103 |
| JP | 02113139 | A * | 4/1990 | F16F 9/096 |
| JP | 03009194 | A * | 1/1991 | F15B 1/103 |
| JP | 2012197908 | | 10/2012 | F15B 15/14 |

OTHER PUBLICATIONS

International Search Report and Written Opinion (w/translation) issued in application No. PCT/JP2018/009637, dated Jun. 19, 2018 (12).

Chinese Official Action for related application serial No. 201880015834.6, dated Mar. 16, 2020 with translation (12 pages).

Extended European Search Report issued in EPO Patent Appln. No. 18 770 448.1-1010, dated Dec. 3, 2020, 7 pages.

* cited by examiner

FLUID EQUIPMENT

TECHNICAL FIELD

The present invention relates to fluid equipment, such as a hydraulic cylinder, applied to machines such as a vehicle, a construction machine, and an industrial machine and configured to transmit energy of operating fluid.

BACKGROUND ART

In machines such as a vehicle, a construction machine, and an industrial machine, a power transmission system is simplified using a fluid pressure circuit incorporating a hydraulic cylinder as fluid equipment configured to transmit energy or power by means of the pressure of operating fluid. The hydraulic cylinder moves a piston in the cylinder by first operating fluid, thereby causing the pressure to act on second operating fluid of a hydraulic chamber on the opposite side of the first operating fluid through the piston. In this manner, power is transmitted.

A fluid pressure cylinder disclosed in Patent Citation 1 mainly includes a cylindrical cylinder tube, a piston provided inside of the cylinder tube, a rod coupled to the piston, and a cylinder head slidably supporting the rod on the cylinder tube. A housing groove is formed at the outer periphery of the piston. A single seal ring slidably contacting the inner periphery of the cylinder tube and two backup wear rings sandwiching the seal ring are attached to the housing groove, and in this manner, the inside of the cylinder tube is substantially hermetically divided into a rod-side fluid pressure chamber and an end-side fluid pressure chamber. According to this configuration, the fluid pressure cylinder introduces, in the cylinder tube, operating fluid from a fluid pressure circuit into each fluid pressure chamber divided by the piston through a port, thereby reciprocating the piston. Accordingly, pressure acts on first operating fluid or second operating fluid through the piston to transmit power, and therefore, the rod can be operated to extend/contract relative to the cylinder tube.

CITATION LIST

Patent Literature

Patent Citation 1: JP 2012-197908 A (Page 4, FIG. 2)

SUMMARY OF INVENTION

Technical Problem

However, in Patent Citation 1, when the operating fluid is introduced into each fluid pressure chamber from the fluid pressure circuit through the port to reciprocate the piston, friction due to sliding is caused between the inner periphery of the cylinder tube and each of the seal ring and the backup wear rings, and for this reason, there is room for improvement in operability of the piston.

The present invention has been made in view of the above-described problem, and is intended to provide fluid equipment capable of enhancing operability of a moving member in a container.

Solution to Problem

For solving the above-described problem, the fluid equipment according to a first aspect of the present invention is fluid equipment comprising a container capable of having a first fluid and a second fluid housed therein, a first fluid outlet/inlet path provided at the container for outflow and inflow of the first fluid, a second fluid outlet/inlet path provided at the container for outflow and inflow of the second fluid, and a moving member capable of moving in the container in response to the pressure of the first fluid, the fluid equipment transmitting energy from the first fluid to the second fluid. The fluid equipment further comprises a first bellows capable of expanding and contracting. The first bellows has a first end portion closed in a sealed state by the moving member and a second end portion fixed to a first inner surface part of the container in a sealed state. An inside of the first bellows is capable of communicating with the first fluid outlet/inlet path.

According to the first aspect, the first bellows whose the first end portion is closed by the moving member and the second end portion is fixed to the first axial end of the inner surface part of the container in the sealed state, and therefore, the first fluid flowing in or flowing out of the first fluid outlet/inlet path and the second fluid flowing in or flowing out of the second fluid outlet/inlet path in the container can be, in the sealed state, separated into the inside and outside of the first bellows. Thus, mixing of the first fluid and the second fluid in the container can be prevented. In addition, friction due to sliding between the container and the moving member is decreased so that operability of the moving member in the container can be enhanced.

In the fluid equipment according to a second aspect of the present invention, the first fluid and the second fluid are non-compressible fluid.

According to the second aspect, the non-compressible second fluid flows in or flows out of the outside of the first bellows in the container, and therefore, a damper effect utilizing fluid resistance of the non-compressible second fluid moving between the container and the moving member in association with movement of the moving member can be obtained. Thus, movement of the moving member in the container can be stabilized.

The fluid equipment according to a third aspect of the present invention includes a second bellows capable of expanding and contracting and having a smaller diameter than that of the first bellows and configured such that an first end portion of the second bellows is closed by the moving member, a second end portion of the second bellows is fixed to a second inner surface part of the container in a sealed state, and compressible fluid is sealed inside.

According to the third aspect, the second bellows is configured to have a smaller diameter than that of the first bellows. In case that the outside of the first bellows and the outside of the second bellows are aligned in the axial direction thereof, a structure can be easily obtained, in which the second fluid in the outside of the second bellows moves to the outside of the first bellows.

In the fluid equipment according to a fourth aspect of the present invention, the second bellows is fixed to the moving member in a coaxial relationship with each other.

According to the fourth aspect, the second bellows is coaxial with the moving member. Accordingly, inclination of the moving member can be reduced, and the moving member can be more stably supported in the container.

In the fluid equipment according to a fifth aspect of the present invention, the moving member includes a guide portion contacting the inner periphery of the container.

According to the fifth aspect, inclination of the moving member can be prevented by the guide portion, and movement of the moving member can be guided along the inner periphery of the container. Thus, straightness upon movement of the moving member can be enhanced.

In the fluid equipment according to a sixth aspect of the present invention, a communication path penetrating the guide portion in a thickness direction and communicating with the outside of the first bellows is provided at the guide portion.

According to the sixth aspect, the second fluid is moved through the communication path penetrating the guide portion in the thickness direction in association with movement of the moving member. Accordingly, fluid resistance of the second fluid can be decreased, and the operability of the moving member can be enhanced.

In the fluid equipment according to a seventh aspect of the present invention, at least a part of the moving member is arranged inside the first bellows.

According to the seventh aspect, the moving member can be supported in a state in which the first bellows and the second bellows partially overlap with each other in the extension direction. Consequently, the container can be compactly configured without shortening expansion lengths of the first bellows and the second bellows.

In the fluid equipment according to an eighth aspect of the present invention, the first fluid and the second fluid are different types of fluid.

According to the eighth aspect, the first fluid and the second fluid as different types of fluid in the container can be prevented from mixing with each other. Thus, the fluid equipment can be applied between fluid pressure circuits using different types of fluid.

DESCRIPTION OF EMBODIMENTS

Hereinafter, modes for carrying out fluid equipment according to the present invention will be described based on embodiments.

First Embodiment

A hydraulic cylinder constituting fluid equipment according to a first embodiment of the present invention will be described with reference to FIGS. 1 to 3.

Figure 1:
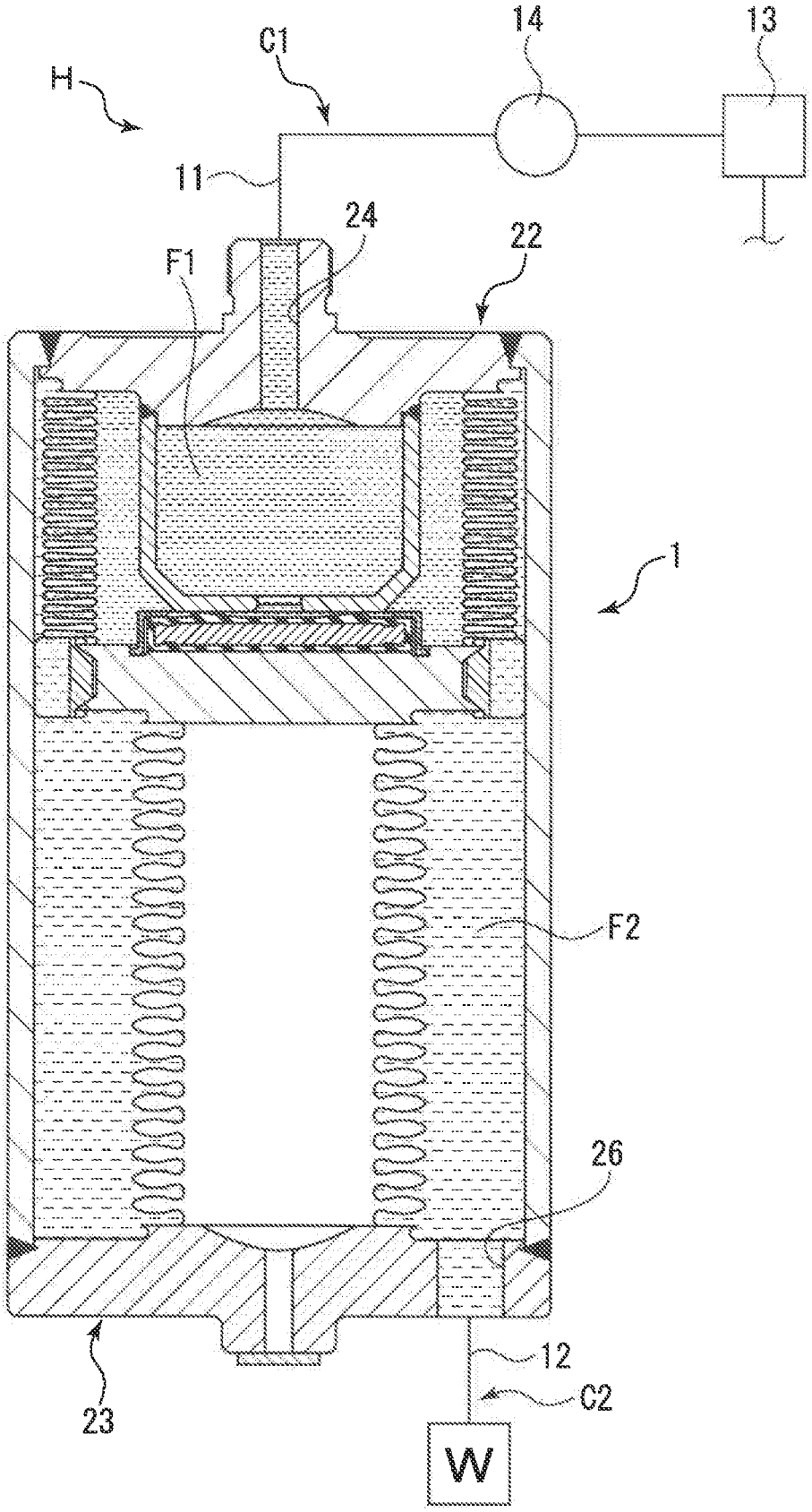
FIG. 1 is a schematic partial sectional view of a hydraulic cylinder constituting fluid equipment according to a first embodiment of the present invention.

As illustrated in FIG. 1, a hydraulic cylinder 1, for example, incorporated in a hydraulic device H of a construction machine, and through a first fluid outlet/inlet path 24 as a through-hole provided at a later-described oil port member 22, is connected to a pressure pipe 11 forming a hydraulic circuit C1. In addition, the hydraulic cylinder 1 is, through a second fluid outlet/inlet path 26 as a through-hole provided at a later-described cover member 23, connected to a pressure pipe 12 forming a hydraulic circuit C2. A hydraulic pump 14 is configured to increase the pressure of operating oil F1 (shown as a first fluid and a non-compressible fluid) stored in a hydraulic reservoir 13 of the hydraulic circuit C1, thereby driving, e.g., a not-shown hydraulic motor for travelling. Moreover, the hydraulic cylinder 1 is operated by the operating oil F1 for energy transmission between the operating oil F1 and operating oil F2 (shown as a second fluid and a non-compressible fluid) for driving a load W such as a rod in the hydraulic circuit C2.

First, a structure of the hydraulic cylinder 1 will be described in detail. As illustrated in FIG. 2, the hydraulic cylinder 1 mainly includes a metal cylinder container 2, a moving member 3 movable in the cylinder container 2 in response to the pressures of the above-described operating oils F1, F2, and a first bellows 4 and a second bellows 5 capable of expanding and contracting, and supporting the moving member 3 in the cylinder container 2. Note that the hydraulic cylinder 1 illustrated in FIG. 2 is in a non-drive state in which the load W is not driven in the hydraulic circuit C2. Further, note that details of driving of the load W by means of energy transmission between the operating oils F1, F2 in the hydraulic cylinder 1 will be described later.

The cylinder container 2 includes a cylindrical shell 21 having openings at both ends, the oil port member 22 welded and fixed to close one end (on a side of a hydraulic circuit C1, see FIG. 1) of the shell 21, and the cover member 23 welded and fixed to close the other end (on a side of a hydraulic circuit C2, see FIG. 1) of the shell 21.

The first fluid outlet/inlet path 24 as the through-hole for outflow and inflow of the operating oil F1 from and to a first liquid chamber 40 set inside the first bellows 4 through the pressure pipe 11 (see FIG. 1) forming the hydraulic circuit C1 is provided at the substantially center of the oil port member 22 in a radial direction, and a metal stay 25 forming a substantially cup shape at the substantially half position in the radial direction is welded and fixed in a standing state.

Note that a communication hole 25*b* penetrating, in a thickness direction, the substantially center of a bottom plate 25*a* in the radial direction is formed at the stay 25, and the first fluid outlet/inlet path 24 of the oil port member 22 and the first liquid chamber 40 set inside the first bellows 4 communicate with each other through the communication hole 25*b*.

A gas sealing port 27 for injecting gas (compressible fluid) such as nitrogen gas into a gas chamber 60 set inside the later-described second bellows 5 is provided at the substantially center of the cover member 23 in the radial direction. The gas sealing port 27 is closed by a gas plug 28 after gas injection.

Moreover, the second fluid outlet/inlet path 26 as the through-hole for outflow and inflow of the operating oil F2 from and to a second liquid chamber 50 set inside the second bellows 5 through the pressure pipe 12 forming the hydraulic circuit C2 (see FIG. 1) is provided on an outer diameter side of the cover member 23.

The moving member 3 is configured such that an annular resin guide member 31 (a guide portion) is fitted onto a discoid metal outer peripheral portion. At the guide member 31, 12 communication paths 31*b* formed in a groove shape along the thickness direction on the outside of the first bellows 4 and arranged at equal intervals in a circumferential direction are provided. The operating oil F2 flowing in or flowing out of the later-described second liquid chamber 50 is movable in the cylinder container 2 through the communication paths 31*b*. Note that arrangement of the communication paths 31*b* and the number of communication paths 31*b* may be other arrangements and numbers than 12 paths at equal intervals.

Moreover, the moving member 3 is configured such that the diameter thereof is the substantially same dimension as the inner diameter of the shell 21 forming the cylinder container 2. Thus, when the moving member 3 moves in the axial direction, an outer peripheral surface 31*a* of the guide member 31 slides on an inner wall surface 21*a* of the shell 21, and as a result the inclination of the moving member 3 can be prevented. In addition, movement of the moving member 3 is smoothly guided along the inner wall surface 21*a* of the shell 21. Note that a material of the guide member 31 may be metal having a low coefficient of friction and exhibiting abrasion resistance other than resin. Further, note that the guide member 31 may be configured such that only the outer peripheral surface 31*a* is made of a material having a low coefficient of friction.

An annular seal holder 32 obtained in such a manner that a metal circular disk is pressed into a crank shape as viewed in a section is welded and fixed to a first planar portion 3*a* of the moving member 3 on a side of an oil port member 22, and a seal member 33 in a discoid shape is held between the first planar portion 3*a* of the moving member 3 and the seal holder 32. Moreover, at a second planar portion 3*b* of the moving member 3 on a side of a cover member 23, a protruding planar portion 3*c* is formed such that the substantially center of the second planar portion 3*b* in the radial direction protrudes in a circular shape toward the cover member 23.

The first bellows 4 is a substantially-cylindrical expandable and contractible metal bellows opening at both ends. The first bellows 4 is welded and fixed to an inner surface (a first inner surface part) of the oil port member 22 to close a fixed end 4*a* (a second end portion) of the first bellows 4, and is welded and fixed to an outer diameter side of the first planar portion 3*a* of the moving member 3 to close a floating end 4*b* (a first end portion) of the first bellows 4. Note that the first bellows 4 is held by the guide member 31 forming the moving member 3 with the floating end 4*b* being pinched by the first planar portion 3*a* of the moving member 3.

The second bellows 5 is a substantially-cylindrical expandable and contractible metal bellows opening at both ends. The second bellows 5 is welded and fixed to an inner surface (a second inner surface part) of the cover member 23 opposed to the oil port member 22 to close a fixed end 5*a* (a second end portion) of the second bellows 5, and is welded and fixed to the protruding planar portion 3*c* formed at the second planar portion 3*b* of the moving member 3 to close a floating end 5*b* (a first end portion) of the second bellows 5 forming an upper end. Moreover, the second bellows 5 is configured to have a smaller diameter than that of the first bellows 4. Further, the first bellows 4 and the second bellows 5 are concentrically arranged in series in an expanding and contracting direction of the bellows on the center axis A (see FIG. 2) of the cylinder container 2 with the moving member 3 being interposed between the first bellows 4 and the second bellows 5.

An internal space of the cylinder container 2 has such a structure that the internal space is, in a sealed state, divided into the first liquid chamber 40 set inside the first bellows 4 and communicating with the first fluid outlet/inlet path 24 of the oil port member 22, the second liquid chamber 50 set outside the first bellows 4 and the second bellows 5 and communicating with the second fluid outlet/inlet path 26 of the cover member 23, and the gas chamber 60 set inside the second bellows 5.

The first liquid chamber 40 is defined by an inner peripheral surface 4*c* of the first bellows 4, the inner surface of the oil port member 22, and the first planar portion 3*a* (the seal holder 32 and the seal member 33) of the moving member 3, and the operating oil F1 can flow in or flow out of the first liquid chamber 40 through the first fluid outlet/inlet path 24 by way of the pressure pipe 11 (see FIG. 1) forming the hydraulic circuit C1.

The second liquid chamber 50 is defined by an outer peripheral surface 5*d* of the second bellows 5, the inner wall surface 21*a* of the shell 21, the inner surface of the cover member 23, the second planar portion 3*b* of the moving member 3, and the guide member 31, and the operating oil F2 can flow in or flow out of the second liquid chamber 50 through the second fluid outlet/inlet path 26 by way of the pressure pipe 12 forming the hydraulic circuit C2. Moreover, as described above, the communication paths 31*b* are provided on an outer diameter side of the guide member 31 forming the moving member 3, and therefore, the operating oil F2 flowing in or flowing out of the second liquid chamber 50 through the second fluid outlet/inlet path 26 can move, in the cylinder container 2, on the outside (between an outer peripheral surface 4*d* of the first bellows 4 and the inner wall surface 21*a* of the shell 21) of the first bellows 4 through the communication paths 31*b*.

The gas chamber 60 is defined by an inner peripheral surface 5*c* of the second bellows 5, the inner surface of the cover member 23, and the protruding planar portion 3*c* of the second planar portion 3*b* of the moving member 3, and the gas is sealed in the gas chamber 60.

Subsequently, energy transmission between the operating oils F1, F2 in the hydraulic cylinder 1 will be described in detail. Note that an example where a not-shown load cylinder operable by the operating oil F2 is, in the hydraulic circuit C2, connected to the load W and the load W is driven by the load cylinder will be described.

Figure 3:
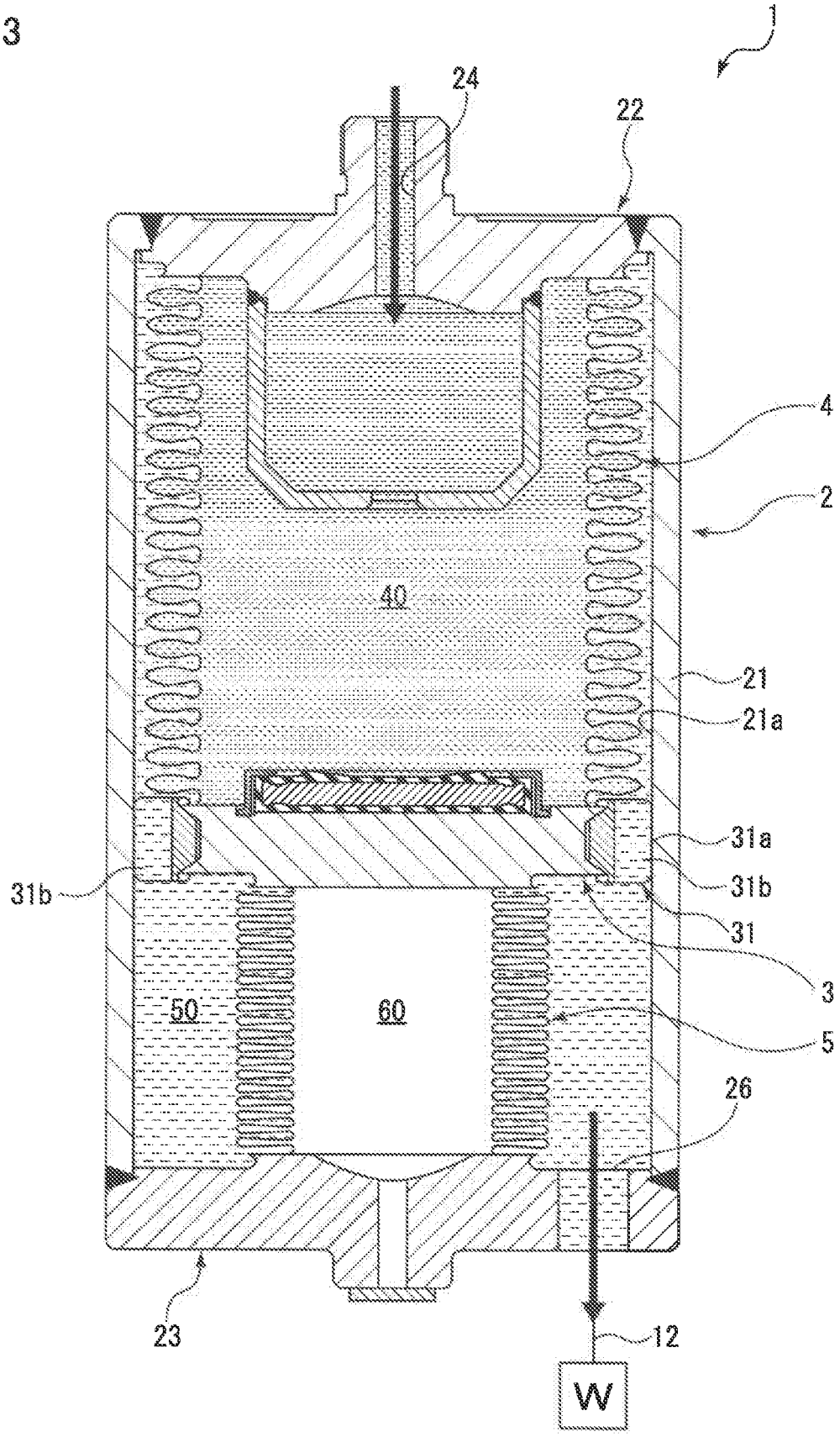
FIG. 3 is a sectional view of the hydraulic cylinder according to the first embodiment in a drive state for driving the load W.

In the hydraulic cylinder 1, the pressure of the operating oil F1 of the hydraulic circuit C1 is increased by the hydraulic pump 14, and accordingly, the operating oil F1 flows in the first liquid chamber 40 through the first fluid outlet/inlet path 24 of the oil port member 22 by way of the pressure pipe 11 forming the hydraulic circuit C1 (see an arrow of FIG. 3). Then, in response to the pressure of the operating oil F1 having flowed in the first liquid chamber 40, the moving member 3 moves toward the cover member 23, and accordingly, extension of the first bellows 4 and contraction of the second bellows 5 occur. At this point, in association with movement of the moving member 3 toward the cover member 23, the operating oil F2 moves from the second liquid chamber 50 to the outside (between the outer peripheral surface 4*d* of the first bellows 4 and the inner wall surface 21*a* of the shell 21) of the first bellows 4 through the communication paths 31*b* of the guide member 31 (see an arrow of FIG. 3).

Moreover, the hydraulic cylinder 1 decreases the volume of the second liquid chamber 50 set outside the second bellows 5 by movement of the moving member 3 toward the cover member 23 and contraction of the second bellows 5, and accordingly, the operating oil F2 in the second liquid chamber 50 is discharged to the pressure pipe 12 forming the hydraulic circuit C2 through the second fluid outlet/inlet path 26 of the cover member 23 (an arrow of FIG. 3). According to this configuration, a drive state for supplying the operating oil F2 from the hydraulic cylinder 1 to the load cylinder to drive the load W is brought in the hydraulic circuit C2.

At this point, in the cylinder container 2, the pressure of the operating oil F2 in the second liquid chamber 50 and the gas pressure in the gas chamber 60 are balanced, and excessive stress is no longer applied to the contracted second bellows 5 in the radial direction. Thus, the shape of the second bellows 5 can be maintained, and damage can be reduced.

From the drive state illustrated in FIG. 3, the hydraulic cylinder 1 switches a not-shown valve provided on a downstream side of the hydraulic pump 14 in the hydraulic circuit C1 to decrease the pressure of the operating oil F1. Accordingly, the operating oil F2 flows in the second liquid chamber 50 from the load cylinder connected to the hydraulic circuit C2 through the pressure pipe 12 and the second fluid outlet/inlet path 26 of the cover member 23 (see an arrow of FIG. 2). A second planar portion 3*b* side of the moving member 3 receives the pressure of the operating oil F2 having flowed in the second liquid chamber 50, and accordingly, the moving member 3 moves toward the oil port member 22 to expand the second bellows 5 and contract the first bellows 4. In this state, by the pressure of the gas compressed in the gas chamber 60 set inside the second bellows 5, restoring force acts in the direction of expanding the second bellows 5, and therefore, the moving member 3 easily moves toward the oil port member 22. Moreover, in this state, the operating oil F2 moves to the second liquid chamber 50 from between the outer peripheral surface 4*d* of the first bellows 4 and the inner wall surface 21*a* of the shell 21 through the communication paths 31*b* of the guide member 31 in association with movement of the moving member 3 toward the oil port member 22 (see an arrow of FIG. 2).

Figure 2:
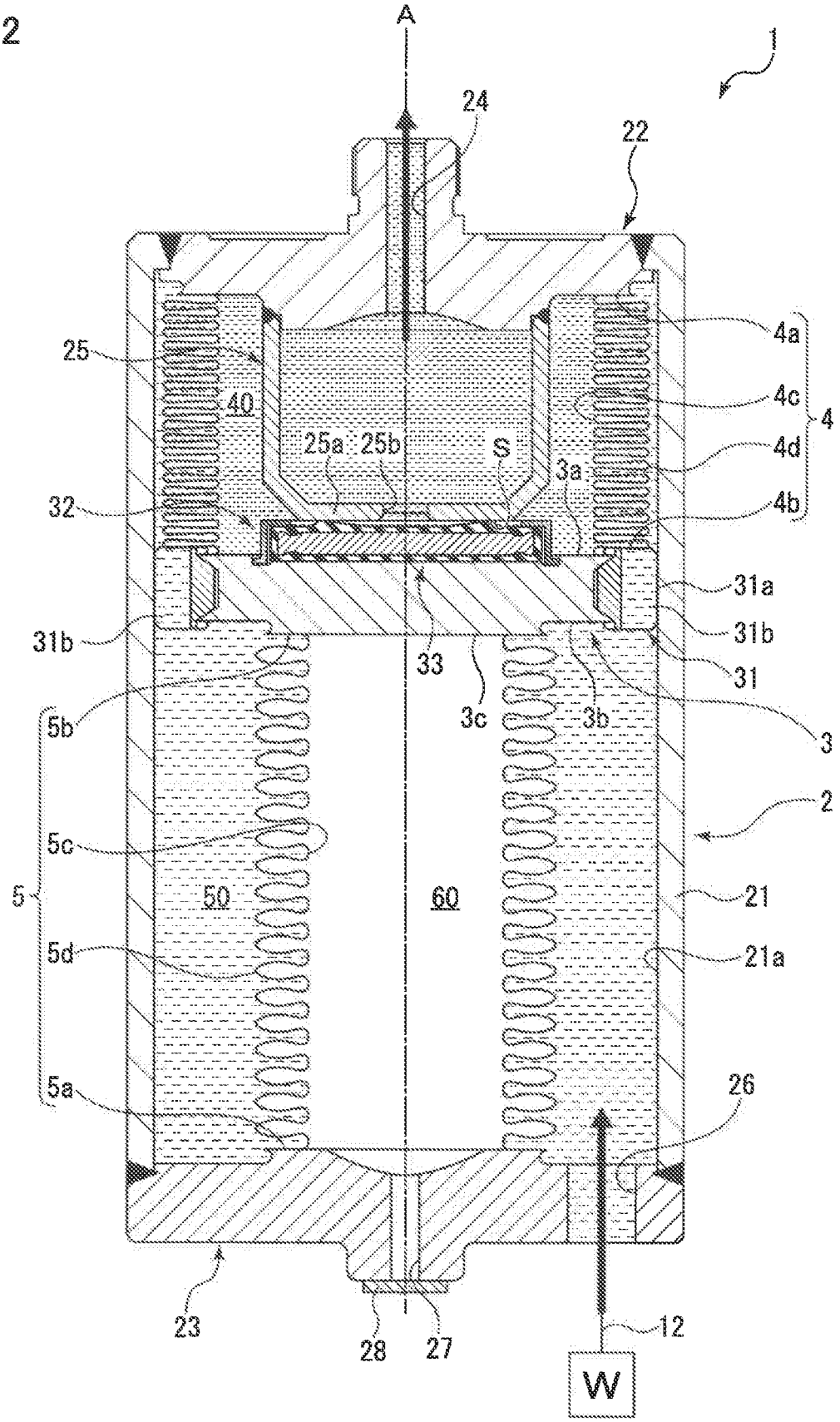
FIG. 2 is a sectional view of the hydraulic cylinder according to the first embodiment in a non-drive state for not driving a load W.

Moreover, the hydraulic cylinder 1 decreases the volume of the first liquid chamber 40 set inside the first bellows 4 by movement of the moving member 3 toward the oil port member 22 and contraction of the first bellows 4, and accordingly, the operating oil F1 in the first liquid chamber 40 is discharged to the pressure pipe 11 forming the hydraulic circuit C1 through the communication hole 25*b* of the stay 25 and the first fluid outlet/inlet path 24 of the oil port member 22 (an arrow of FIG. 2). According to this configuration, the seal member 33 attached to the first planar portion 3*a* of the moving member 3 and the bottom plate 25*a* of the stay 25 provided at the oil port member 22 in the cylinder container 2 closely contact each other, and a non-drive state illustrated in FIG. 2 is brought.

In this state, the seal member 33 and the bottom plate 25*a* of the stay 25 closely contact each other in the cylinder container 2 to form an annular seal portion S, and therefore, the communication hole 25*b* of the stay 25 is closed. According to this configuration, part of the operating oil F1 is kept in the first liquid chamber 40. The pressure of the kept operating oil F1 and the pressure of the operating oil F2 having flowed in the second liquid chamber 50 are balanced, and therefore, excessive stress is no longer-applied to the contracted first bellows 4. Thus, the shape of the first bellows 4 can be maintained, and damage can be reduced.

As described above, the hydraulic cylinder 1 moves the moving member 3 in the cylinder container 2 in the axial direction by the pressure of the operating oil F1, and therefore, causes the pressure to act between the operating oils F1, F2 through the moving member 3 to transmit the energy.

Moreover, in the cylinder container 2, the operating oil F1 flowing in/out through the first fluid outlet/inlet path 24 and the operating oil F2 flowing in/out through the second fluid outlet/inlet path 26 can be, in the sealed state, divided to the inside and outside of the first bellows 4. Thus, mixing of the operating oils F1, F2 in the cylinder container 2 can be prevented. In addition, friction due to sliding between the cylinder container 2 and the moving member 3 is decreased, and operability of the moving member 3 in the cylinder container 2 can be enhanced.

Moreover, the operating oil F2 as the non-compressible fluid flows in or flows out of the second liquid chamber 50 through the second fluid outlet/inlet path 26 in the cylinder container 2, and therefore, a damper effect utilizing fluid resistance of the operating oil F2 generated upon movement in the cylinder container 2 through the communication paths 31*b* of the guide member 31 provided outside the first bellows 4 in association with movement of the moving member 3 can be obtained. Thus, movement of the moving member 3 in the cylinder container 2 can be stabilized.

Further, the operating oil F2 moves through the communication paths 31*b* provided at the guide member 31 in the cylinder container 2. Accordingly, the fluid resistance of the operating oil F2 can be decreased, and the pressures of the operating oils F1, F2 necessary for movement of the moving member 3 can be decreased. Thus, the operability of the moving member can be enhanced. Note that the size of the communication path 31*b* provided at the guide member 31 is changed so that the fluid resistance of the operating oil F2 moving through the communication paths 31*b* can be adjusted. Thus, the speed of movement of the moving member 3 in the cylinder container 2 can be controlled.

Moreover, the second bellows 5 is configured to have a smaller diameter than that of the first bellows 4, and therefore, the outside of the first bellows 4 and the outside of the second bellows 5 are aligned in the expanding and contracting direction of the bellows. Thus, a structure can be easily obtained, in which the operating oil F2 moves between the outside of the first bellows 4 and the outside of the second bellows 5 with respect to the moving member 3 and the guide member 31 in the second liquid chamber 50. Further, the second bellows 5 is configured to have a smaller diameter than that of the first bellows 4. Thus, it can be configured such that a pressure receiving area of the second planar portion 3*b* side of the moving member 3 for the operating oil F2 flowing in or flowing out of the second liquid chamber 50 from the second fluid outlet/inlet path 26 is large, and it can be configured such that a pressure receiving area of the moving member 3 of a side of the first planar portion 3*a* for the operating oil F1 flowing in or flowing out of the first liquid chamber 40 through the first fluid outlet/inlet path 24 is large. Consequently, responsiveness of the moving member 3 to the pressures of the operating oils F1, F2 can be enhanced.

Moreover, the moving member 3 is, in the cylinder container 2, supported by the first bellows 4 and the second bellows 5 concentrically arranged in series in the expanding and contracting direction, and therefore, the moving member 3 can be stably supported in the cylinder container 2. Further, the shape of the second bellows 5 can be easily maintained by the pressure of the gas sealed in the gas chamber 60 set inside the second bellows 5, and therefore, the moving member 3 can be more stably supported in the cylinder container 2.

Moreover, the second bellows 5 is fixed to the substantially center of the moving member 3. Accordingly, inclination of the moving member 3 can be reduced, and the moving member 3 can be more stably supported in the cylinder container 2. As described above, the moving member 3 is stably supported by the first bellows 4 and the second bellows 5, and therefore, straightness upon movement of the moving member 3 in the cylinder container 2 can be enhanced.

Moreover, as described above, the internal space of the cylinder container 2 can be, in the sealed state, divided into the inside and outside of the first bellows 4, and therefore, mixing of the operating oils F1, F2 between the first liquid chamber 40 and the second liquid chamber 50 can be prevented without enhancing sealability between the cylinder container 2 (the inner wall surface 21*a* of the shell 21) and the moving member 3 (the outer peripheral surface 31*a* of the guide member 31).

Specifically, as described above as the background art, in a case where a not-shown seal member slidably contacting the inner wall surface 21*a* of the shell 21 is, for example, provided at an outer peripheral portion of the moving member 3 to substantially hermetically divide the internal space of the cylinder container 2 into the first liquid chamber 40 and the second liquid chamber 50 by the moving member 3 to prevent mixing of the operating oils F1, F2, if an attempt is made to enhance sealability by the seal member to prevent mixing of the operating oils F1, F2, friction between the inner wall surface 21*a* of the shell 21 and the seal member of the moving member 3 is caused. In this case, the seal member is abraded due to repeated movement of the moving member 3 in the cylinder container 2, and for this reason, there is a probability that the sealability by the seal member is lowered to cause mixing of the operating oils F1, F2. Moreover, in this case, sliding resistance of the moving member 3 against the inner wall surface 21*a* of the shell 21 is caused. For this reason, not only the pressures of the operating oils F1, F2 necessary for moving the moving member 3 are increased, but also the hydraulic cylinder 1 needs to be regularly disassembled to replace the abraded seal member. This also lowers maintainability.

On the other hand, the hydraulic cylinder 1 of the present embodiment can divide, in the sealed state, the internal space of the cylinder container 2 into the inside and outside of the first bellows 4, and therefore, mixing of the operating oils F1, F2 between the first liquid chamber 40 and the second liquid chamber 50 can be prevented. Friction of the moving member 3 (the outer peripheral surface 31*a* of the guide member 31) against the inner wall surface 21*a* of the shell 21 is decreased. Thus, the hydraulic cylinder 1 can be provided, in which the operability of the moving member 3 in the cylinder container 2 can be enhanced and no abrasion of the moving member 3 is caused for a long period of time. In addition to mixing of the operating oils F1, F2, mixing of abrasion powder of the seal member can be also prevented. Thus, driving of the load W can be maintained with high accuracy.

Moreover, mixing of the operating oils F1, F2 in the cylinder container 2 can be prevented. Thus, even in the case of different types of the operating oil F1, F2, the hydraulic cylinder 1 can be applied between the hydraulic circuits C1, C2.

Second Embodiment

Next, fluid equipment according to a second embodiment of the present invention will be described with reference to FIGS. 4 and 5. Note that the same reference numerals are used to represent the same components as those described in the above-described embodiment, and overlapping description will be omitted.

Figure 4:
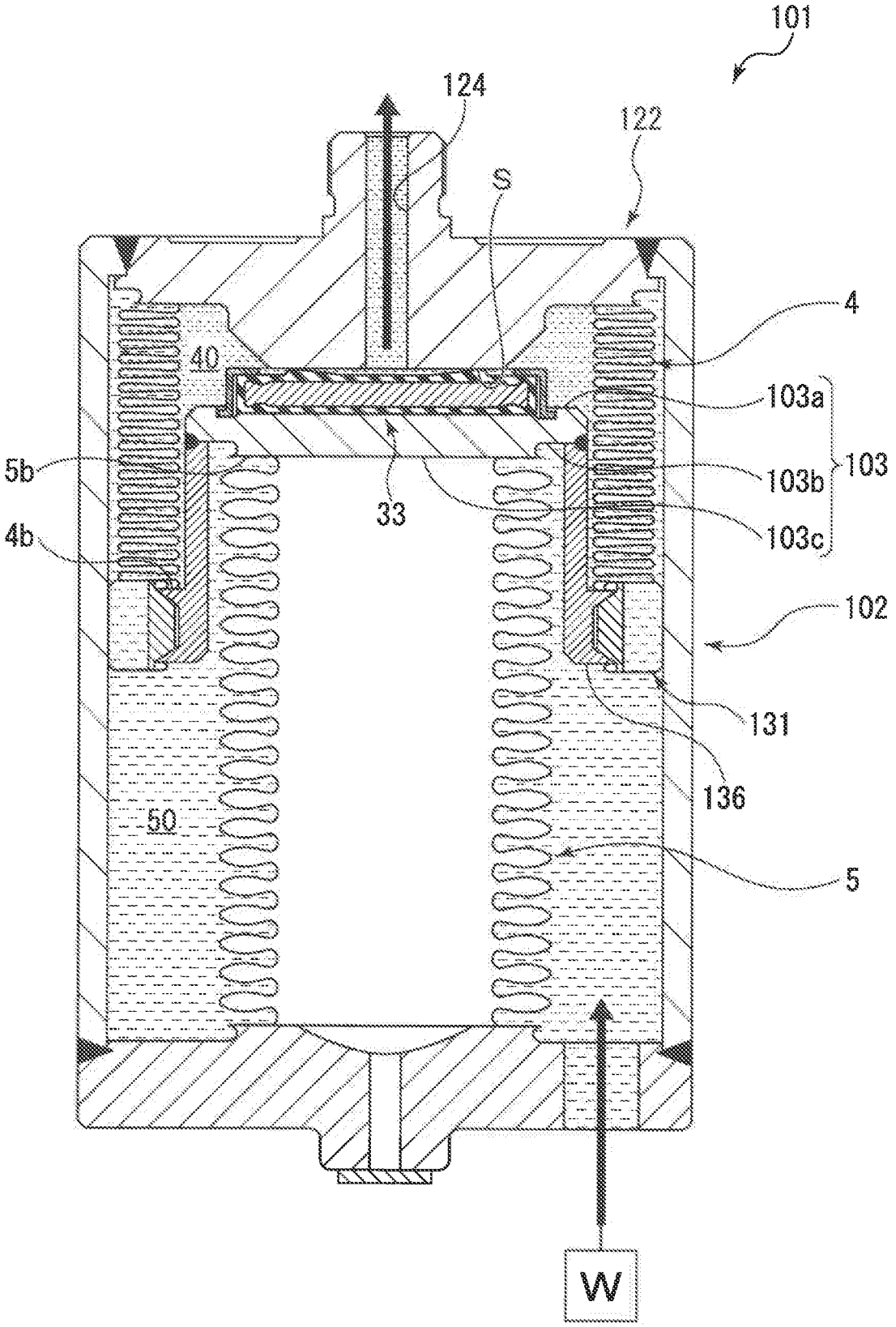
FIG. 4 is a sectional view of a hydraulic cylinder constituting fluid equipment according to a second embodiment of the present invention in a non-drive state for not driving a load W.
Figure 5:
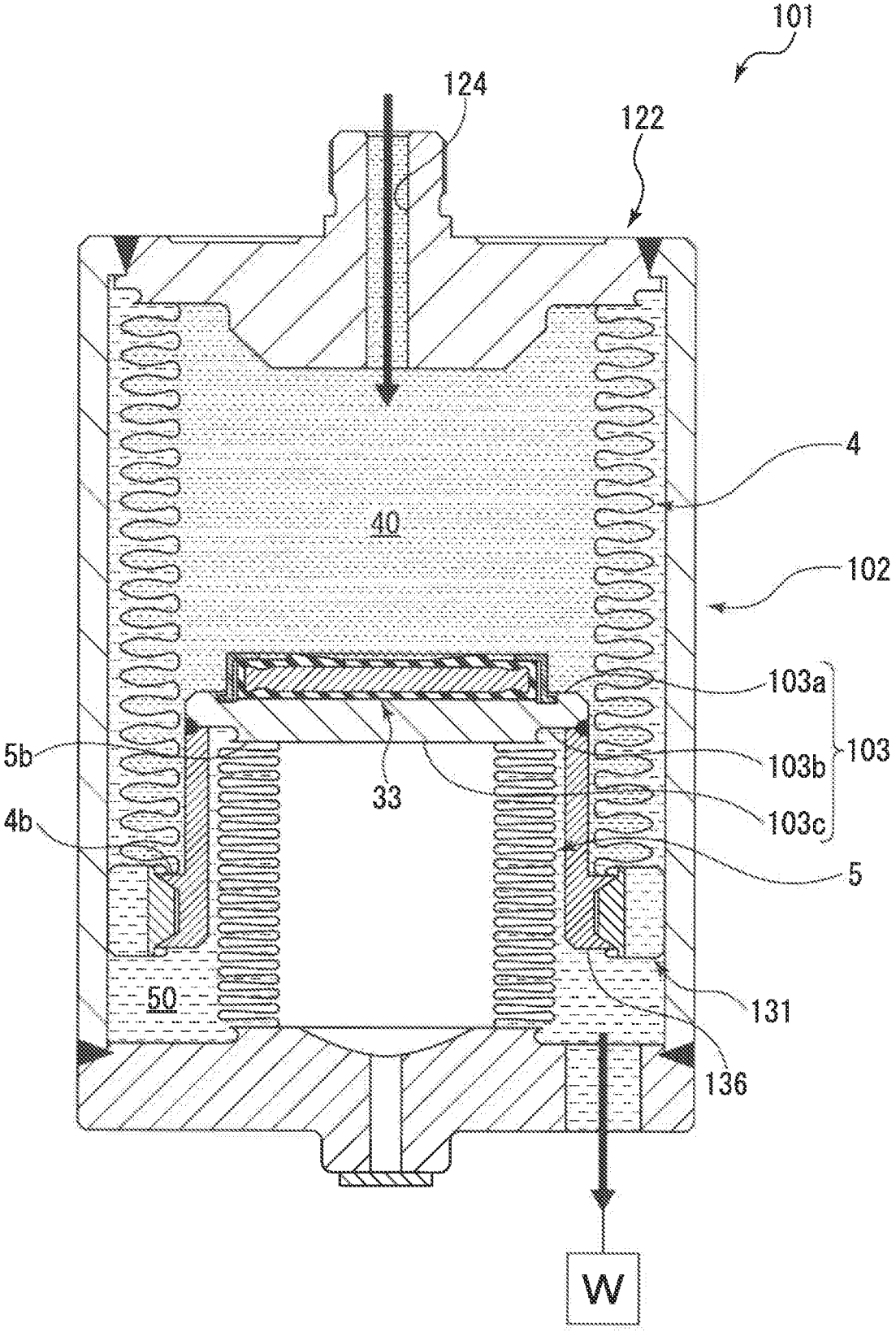
FIG. 5 is a sectional view of the hydraulic cylinder according to the second embodiment in a drive state for driving the load W.

As illustrated in FIGS. 4 and 5, in a hydraulic cylinder 101 as the fluid equipment according to the second embodiment, a moving member 103 is arranged inside a first bellows 4, and one end of a cylindrical coupling member 136 to be fitted in an inner peripheral portion of a guide member 131 is welded and fixed to an outer diameter side of a second planar portion 103*b* of the moving member 103.

Moreover, a floating end 4*b* of the first bellows 4 is welded and fixed with the floating end 4*b* being sandwiched between the guide member 131 and the other end of the coupling member 136.

According to this configuration, a floating end 5*b* of a second bellows 5 is closed by a protruding planar portion 103*c* of the moving member 103 arranged inside the first bellows 4, and therefore, the moving member 103 can be supported in a state in which the first bellows 4 and the second bellows 5 partially overlap with each other in an extension direction. Consequently, a cylinder container 102 can be compactly configured without shortening expansion lengths of the first bellows 4 and the second bellows 5 upon movement of the moving member 103 in an axial direction.

Moreover, as illustrated in FIG. 4, in a non-drive state of the hydraulic cylinder 101, a seal member 33 attached to a first planar portion 103*a* of the moving member 103 and an inner surface of a first fluid outlet/inlet path 124 of an oil port member 122 closely contact each other to form an annular seal portion S in the cylinder container 102, and therefore, the first fluid outlet/inlet path 124 is closed. According to this configuration, part of operating oil F1 is kept in a first liquid chamber 40, and the pressure of the kept operating oil F1 and the pressure of operating oil F2 having flowed in a second liquid chamber 50 are balanced. Thus, excessive stress is no longer applied to the contracted first bellows 4. Consequently, the shape of the first bellows 4 can be maintained, and damage can be reduced.

Third Embodiment

Next, fluid equipment according to a third embodiment of the present invention will be described with reference to FIG. 6. Note that the same reference numerals are used to represent the same components as those described in the above-described embodiments, and overlapping description will be omitted. Further, note that for the fluid equipment according to the third embodiment, only a non-drive state is illustrated in the figure, and a drive state is not shown in the figure.

Figure 6:
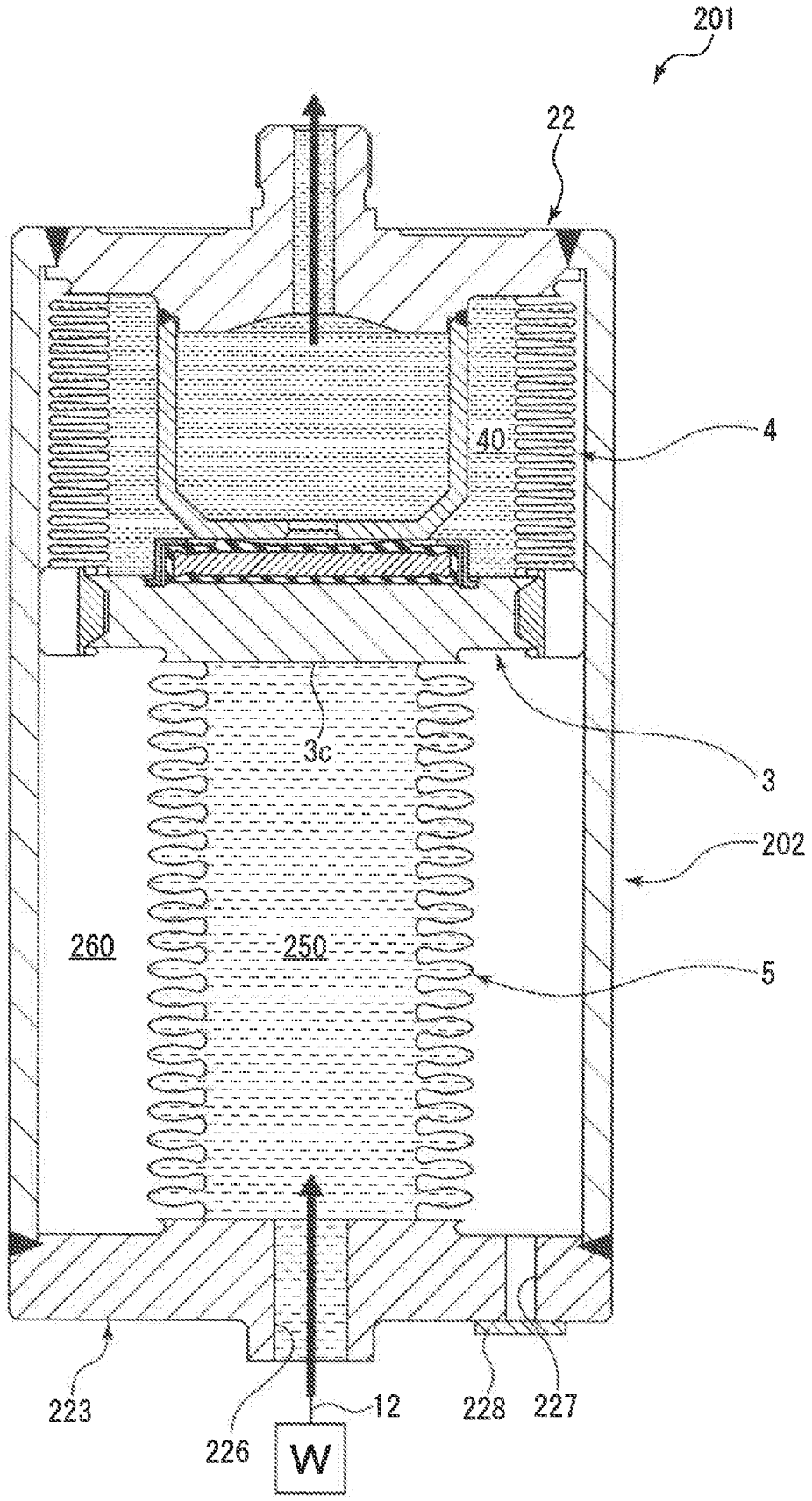
FIG. 6 is a sectional view of a hydraulic cylinder constituting fluid equipment according to a third embodiment of the present invention in a non-drive state for not driving a load W.

As illustrated in FIG. 6, in a hydraulic cylinder 201 shown as the fluid equipment of the third embodiment, a second fluid outlet/inlet path 226 for outflow/inflow of operating oil F2 as non-compressible fluid from/to a second liquid chamber 250 set inside a second bellows 5 through a pressure pipe 12 forming a hydraulic circuit C2 (see FIG. 1) is provided at the substantially center of a cover member 223 in a radial direction.

Moreover, a gas sealing port 227 for injecting gas such as nitrogen gas into a gas chamber 260 set outside the second bellows 5 is provided on an outer diameter side of the cover member 223, and is closed by a gas plug 228 after gas injection.

According to this configuration, in the non-drive state of the hydraulic cylinder 201, the pressure of the operating oil F2 for moving a moving member 3 toward an oil port member 22 can be received by a protruding planar portion 3*c* formed at a substantially center portion of the moving member 3 in the radial direction in the second liquid chamber 250 hermetically set inside the second bellows 5. Thus, the pressure of the operating oil F2 can be efficiently utilized to enhance operability of the moving member 3 in a cylinder container 202.

Moreover, the gas chamber 260 is interposed between a first liquid chamber 40 and a second liquid chamber 50, and therefore, operating oil F1 and the operating oil F2 are less mixed. That is, even when sealing of a first bellows 4 or the second bellows 5 becomes insufficient, the operating oil F1 and the operating oil F2 are less mixed.

The embodiments of the present invention have been described above with reference to the drawings, but specific configurations are not limited to these embodiments. Changes and additions made without departing from the gist of the present invention are also included in the present invention.

In the above-described embodiments, the operating oils F11, F2 have been described as an example of operating fluid used for the hydraulic cylinder 1, but at least one of the operating fluids may be compressible fluid.

Moreover, in the above-described embodiments, it has been described that the first bellows 4 and the second bellows 5 are provided in the cylinder container 2, 102, 202. However, at least one bellows may be provided in the cylinder container, and the operating fluids flowing in or flowing out of the first fluid outlet/inlet path and the second fluid outlet/inlet path may be, in the sealed state, separated by the bellows.

Further, in the above-described embodiments, the aspect has been described, in which the gas is sealed in the second bellows 5. However, a restoring unit configured to provide the restoring force to the contracted second bellows may be provided inside the second bellows. For example, a spring etc. may be provided inside the second bellows to provide the restoring force in the direction of expanding the second bellows.

In addition, in the above-described embodiments, the aspect has been described, in which the separate guide member 31 is fitted onto the metal discoid outer peripheral portion forming the moving member 3. However, the guide portion may be integrally configured with the metal discoid outer peripheral portion forming the moving member.

Moreover, in the above-described embodiments, the aspect has been described, in which the outer peripheral surface of the guide member 31, 131 slides on the inner wall surface 21*a* of the shell 21 in association with movement of the moving member 3, 103. However, the outer peripheral surface of the guide member may be separated from the inner wall surface of the shell to reduce sliding between the inner wall surface of the shell and the outer peripheral surface of the guide member.

Further, in the above-described embodiments, it has been described that the communication paths 31*b* are provided at the guide member 31. However, as long as the communication paths are on the outside of the first bellows 4, the communication paths may be provided at the metal disk forming the moving member 3.

In addition, the communication path 31*b* is not limited to the groove shape, but may be in a through-hole shape or a slit shape.

Moreover, the example has been described, in which the cylinder container 2 is configured such that the shell 21, the oil port member 22, and the cover member 23 are formed from separate members. However, the shell 21 and the oil port member 22 or the cover member 23 may be formed as a single member.

Figure 7:
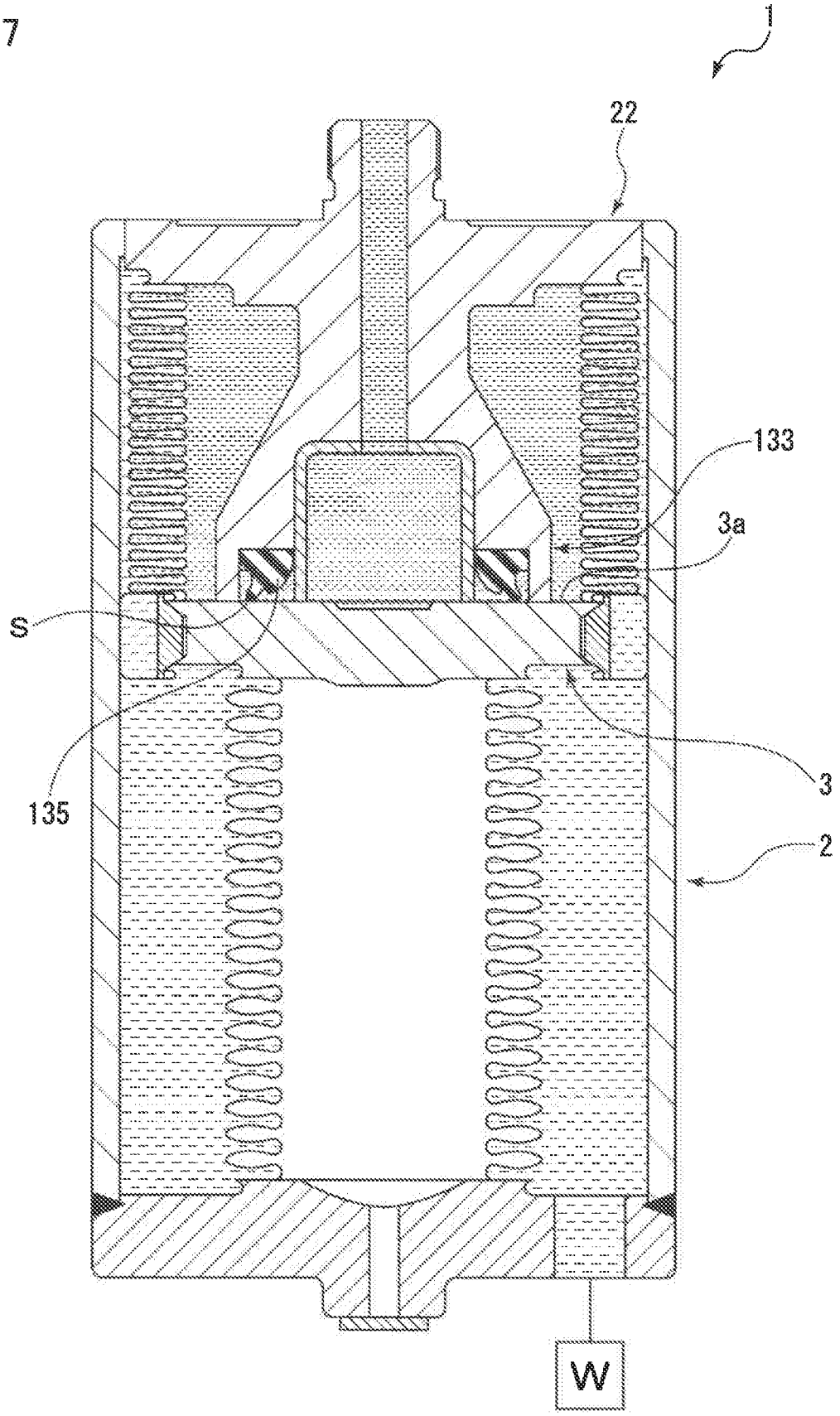
FIG. 7 is a sectional view of a variation of the hydraulic cylinder constituting fluid equipment according to the present invention.

Further, instead of the stay 25, a seal member 133 (see FIG. 7) having a lip seal 135 may be provided integrally with the oil port member 22, and the first planar portion 3*a* of the moving member 3 may be directly closely contact the lip seal 135.

In addition, the first bellows 4 and the second bellows 5 are not limited to the metal bellows, and may be made of resin etc.

REFERENCE SIGNS LIST

1 hydraulic cylinder
2 cylinder container
3 moving member
4 first bellows
4*a* fixed end (second end portion)
4*b* floating end (first end portion)
5 second bellows
5*a* fixed end (second end portion)
5*b* floating end (first end portion)
11, 12 pressure pipe
21 shell
22 oil port member
23 cover member
24 first fluid outlet/inlet path
26 second fluid outlet/inlet path
27 gas sealing port
31 guide member (guide portion)
31*b* communication path
40 first liquid chamber
50 second liquid chamber
60 gas chamber
101 hydraulic cylinder (fluid equipment)
201 hydraulic cylinder (fluid equipment)
C1, C2 hydraulic circuit
F1, F2 operating oil (first fluid, second fluid)
H hydraulic device
S seal portion
W load

The invention claimed is:

1. Fluid equipment comprising a container configured for holding a first fluid and a second fluid housed therein, a first fluid outlet/inlet path provided at the container for outflow and inflow of the first fluid, a second fluid outlet/inlet path provided at the container for outflow and inflow of the second fluid, and a moving member configured for moving in the container in response to a pressure of the first fluid, the fluid equipment transmitting energy from the first fluid to the second fluid, the fluid equipment further comprising a first bellows and a second bellows configured for expanding and contracting, the first bellows having a first end portion closed in a sealed state by the moving member and a second end portion fixed to a first inner surface part of the container in a sealed state, the second bellows being opposed to the first bellows through the moving member, said second bellows having a first end portion closed in a sealed state by the moving member and a second end portion fixed to a second inner surface part of the container in a sealed state, an inside of the first bellows being configured for communicating with the first fluid outlet/inlet path, the first fluid and the second fluid being non-compressible fluid, the container being provided with a first fluid chamber formed inside the first bellows and a second fluid chamber formed inside the second bellows, the first fluid chamber and the second fluid chamber storing the first fluid and the second fluid, respectively, and being in non-communication, the fluid equipment further comprising a seal member attached to the moving member, the seal member being configured for closing the first fluid outlet/inlet path, the second bellows being smaller than the first bellows in diameter, and a gas chamber being formed outside the second bellows and the first bellows and having a gas injected thereinto.

2. The fluid equipment according to claim 1, wherein the moving member has a first surface portion partially defining the first fluid chamber and a second surface portion opposed to the first surface portion and partially defining the second fluid chamber.

3. The fluid equipment according to claim 2, wherein the moving member includes a guide portion contacting an inner periphery of the container.

4. The fluid equipment according to claim 3, wherein a communication path penetrating the guide portion in a thickness direction and communicating with an outside of the first bellows is provided at the guide portion.

5. The fluid equipment according to claim 2, wherein the first fluid and the second fluid are different types of fluid.

6. The fluid equipment according to claim 1, wherein the second bellows is fixed to the moving member in a coaxial relationship with the moving member.

7. The fluid equipment according to claim 6, wherein the moving member includes a guide portion contacting an inner periphery of the container.

8. The fluid equipment according to claim 6, wherein the first fluid and the second fluid are different types of fluid.

9. The fluid equipment according to claim 1, wherein the moving member includes a guide portion contacting an inner periphery of the container.

10. The fluid equipment according to claim 9, wherein a communication path penetrating the guide portion in a thickness direction and communicating with an outside of the first bellows is provided at the guide portion.

11. The fluid equipment according to claim 1, wherein the first fluid and the second fluid are different types of fluid.

* * * * *